United States Patent [19]

Costa

[11] Patent Number: 4,913,351

[45] Date of Patent: Apr. 3, 1990

[54] SPRINKLER SYSTEM HAVING INDIVIDUAL MULTI-MODE SPRINKLER HEADS WITH CONVENIENT PRESSURE READING AND ADJUSTMENT

[75] Inventor: Robert B. Costa, Covina, Calif.

[73] Assignee: Thompson Manufacturing Company, Chino, Calif.

[21] Appl. No.: 98,297

[22] Filed: Sep. 18, 1987

[51] Int. Cl.[4] ..... B05B 12/00

[52] U.S. Cl. ..... 239/74; 239/201; 239/203; 137/557

[58] Field of Search ..... 239/71, 201, 203–206, 239/68, 69, 74; 251/26, 30.05, 41, 46; 137/491, 557

[56] References Cited

U.S. PATENT DOCUMENTS

| | | | |
|---|---|---|---|
| B 405,305 | 1/1975 | Deters | 137/491 X |
| 1,046,427 | 12/1912 | Barney | 239/201 |
| 2,890,714 | 6/1959 | Greenwood et al. | 137/491 X |
| 3,022,039 | 2/1962 | Cone et al. | 251/46 |
| 3,046,747 | 7/1962 | Timpe | 239/201 X |
| 3,854,497 | 12/1974 | Rosenberg | 137/557 |
| 4,180,236 | 12/1979 | Saareni et al. | 251/46 X |
| 4,226,259 | 10/1980 | Szekely et al. | 251/30.02 X |
| 4,235,414 | 11/1980 | Lis | 251/46 X |
| 4,512,517 | 4/1985 | Manor | 239/206 |
| 4,603,832 | 8/1986 | Sjoquist | 251/46 X |

*Primary Examiner*—Andres Kashnikow

*Attorney, Agent, or Firm*—Jackson & Jones

[57] ABSTRACT

A sprinkler head having a readily accessible top plug which can be removed and replaced by a pressure-reading gauge that is in fluid communication with the head's interior pressure. Each individual sprinkler head includes a manually-adjustable pressure adjusting screw which is accessible at an exposed location for the installed sprinkler head. Pressure adjustment for an individual head, while it is operating in either a manual or an automatic mode, is available. After individual pressure adjustment for a sprinkler head has been performed the gauge is removed and the plug is replaced for normal sprinkler operation.

1 Claim, 3 Drawing Sheets

SPRINKLER SYSTEM HAVING INDIVIDUAL MULTI-MODE SPRINKLER HEADS WITH CONVENIENT PRESSURE READING AND ADJUSTMENT

ORIGIN OF THE INVENTION

This invention was made by a sole inventor and assigned to the assignee hereof to satisfy a heretofor unsatisfied need for an improvement in sprinkler systems.

BACKGROUND OF THE INVENTION

Sprinkler systems having a plurality of pop-up type sprinkler heads are well known and involve sophisticated individual watering heads for large scale irrigation of parks, golf courses and the like. Such systems involve a lateral line fitted with a plurality of heads for that one line. The various lateral lines are fed from larger water supply pipes. Electrical control is commonly provided from a master control box electrically connected to and remotely located from each of the individual heads.

On each lateral line supplied by a larger water supply pipe, the individual heads are designed for an optimum water pressure. Spacing along the lateral line during an original installation is determined by parameters based upon a given number of individual heads operating at a presumed water pressure that is idealized for the individual heads. The area of coverage by each head is also a function of the individual head's supply pressure. Skill is required to design a lateral layout to suit the particular watering needs of the contours and areas for each lateral line with its plurality of individual heads.

At the point of connection of each head on a single lateral line, the amount of supply pressure varies as one moves from the supply source to the last head on the line. More pressure is available at the head of the line at the point closest to the supply source than is available at the last terminating head on that lateral. Each individual head during installation of the system may be supplied with an individual pressure adjustment usually located at the area where the head is connected to the water supply line. The adjustment mechanism is thus normally located at an underground location after the system is installed. One typical prior art valve of the type that requires digging is shown in U.S. Pat. No. 4,226,259. While the valve of the identified patent is asserted to apply to pressure regulation it is not applicable to individual head pressure adjustment with the features provided by this invention.

If the overall system design is not perfect or if the optimum pressure, at some later time, is not achieved the coverage pattern for the heads on that lateral may turn out to be defective. One solution is to dig underground and attempt to read and individually vary the pressure adjustments so that some heads may have more pressure than others.

The master electrical control is located remotely from the heads and this distance increases the complexity of the pressure adjustment task. If all of the heads are provided with individual manual on/off control, pressure adjustment is somewhat simplified. A manual on/-off control for an individual head is, of course, well known.

Pop-up heads when not in use are often recessed in a housing and the spray nozzles are covered by an upper cover. These heads rely upon water pressure inside the sprinkler to pop-up the head and also to rotate the head while it is spraying. Water exiting from the spray nozzles also drives the head's nozzle in rotation as it sprays an area. If coverage after installation is not adequate the spray pressure must be read and if possible, adjusted relative to the spray pressure of other heads on the given lateral.

One technique used to read the spray, or outside water pressure, is to employ a pitot tube which is affixed to a standard pressure gauge. A technician, when the system is operating, inserts the pitot tube at the nozzle location into the exiting spray. The tube is manually moved around in the exiting spray in an attempt to locate the highest spray pressure. The pitot tube affects the spray, disrupts the spray nozzles movement, and at best is an approximate reading. The technician gets soaked and is not at all confident of the exactness of his readings.

In some dual nozzle pop-up heads, one nozzle does the spraying while a secondary nozzle drives the head for rotation. In this dual-nozzle type the drive is not interrupted by the pitot tube, but the spray reading is still affected by the presence of the pitot tube in the spray. One still gets soaked and does not have confidence in the pressure readings.

Since the pressure adjustment for individual heads in the prior art is located underground the operating personnel must dig up the heads to achieve individual adjustments. Moreover, the adjustments must be done while moving the pitot tube around in the spray and cannot be done by a single technician. In general the prior art pressure adjustments present a difficult and inexact task which often involves several people.

What has not, prior to this invention, been readily available is a remotely controlled pop-up head that can easily and simply have each head's internal pressure read directly and adjusted by one person who remains dry during the task and has confidence in the correctness of the pressure readings.

SUMMARY OF THE INVENTION

The invention comprises an individual remotely controlled pop-up type sprinkler head having a readily accessible top cover which can be removed and replaced by a pressure-reading gauge that is in fluid communication with the head's interior nozzle fluid stream. A supply valve which is responsive to a pressure differential is connected between the sprinkler head and the underground supply conduit for the sprinkler head. Pressure differential control means for each individual head incudes a pressure adjusting screw and a manual on/off control, both of which are readily accessible at an exposed location on the installed head, and which share a common pressure bleed and return conduit. Pressure adjustment for an individual head, while it is operating in either a manual on or an automatic mode is available. The task of individual pressure adjustment for each spray head becomes a single-person job that can be performed without getting sprayed during the reading or adjustment and avoids digging up each individual head.

DETAILED DESCRIPTION OF THE DRAWING

Figure 1:
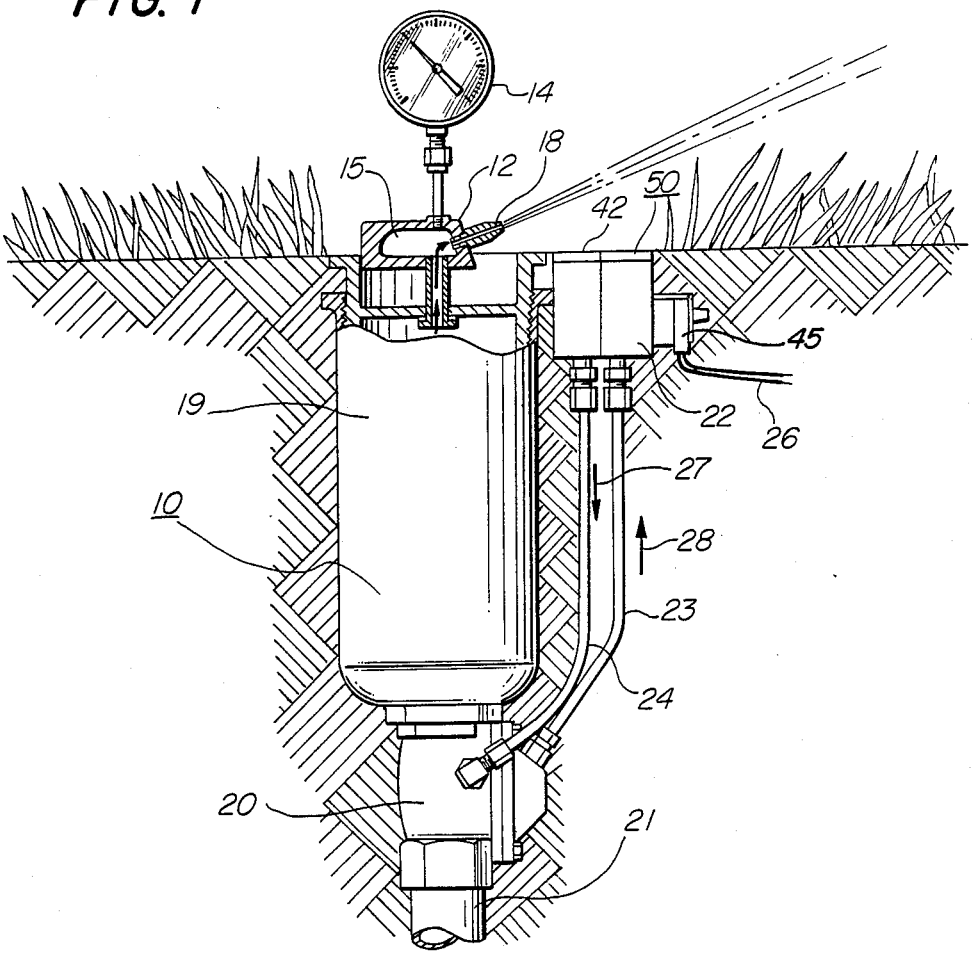
FIG. 1 shows a partially cut away view of the ground-level multi-mode pressure adjustable pop-up head of this invention.

FIG. 1 depicts a partially cut away view of the sprinkler 10 of this invention. In sprinkler 10, a pop-up head 12 is shown in spraying condition. A cover 16, FIG. 3, has been removed by removal of screw 17, FIG. 3. In the screw's location, a standard pressure gauge 14, FIG. 1, has been threadably inserted into water communication with the sprinkler's nozzle chamber 15. Nozzle 18 communicating with chamber 15 may be of any well known type. Housing 19 includes at the bottom thereof a valve 20 which is connected by a pipe 21 into a lateral line not shown.

At the upper right in FIG. 1 is a pressure and mode control unit 22. Unit 22 may be connected to housing 19 or cast therein as part of the housing 19. Inlet and outlet conduits 23, 24 are coupled between valve 20 and control 22. These conduits carry water in the direction shown by the arrows 27, 28 in order to open or close valve 20. Electrical control leads 26, which may come fom a master control (not shown), are for automatic control of the sprinkler head 10. Such automatic control involves electrical activation of a solenoid within control 22. The solenoid, in a manner to be described, remotely opens or closes valve 20 and thus controls the operating state of sprinkler 10.

It should be understood that gauge 14 replaces cover 16 and screw 17 only when it is necessary, during installation or maintenance, to read the spray pressure for sprinkler 10. It should also be noted that in accordance with this invention the pressure is read directly rather than indirectly as is the case of the pitot tube described in connection with the prior art.

Figure 3:
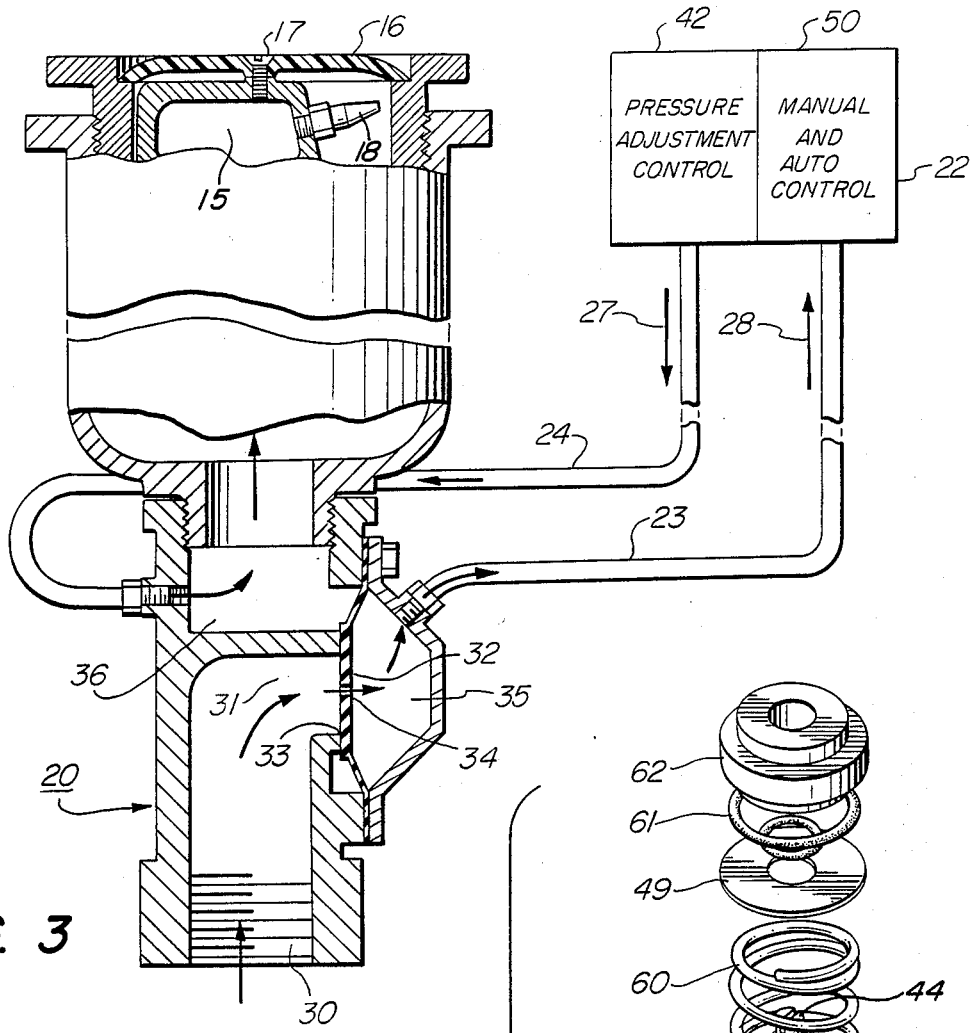
FIG. 3 is a simplified lower valve that is adjustable by an accessible ground-level pressure adjusting means.

FIG. 3 depicts in simplified form, a basic valve operation for sprinkler head 10. Valve 20 includes an inlet connection point 30 which is connected to the lateral water line. Inlet housing portion 31, of valve 20, includes a valve diaphram 32 which is seated against a valve seat 33. An opening 34 in diaphram 32 allows the inlet flow to enter into a secondary chamber 35 which separates the valve's inlet chamber 31 from an outlet chamber 36 for valve 20.

Assume a static closed condition for valve 20 with diaphram 34 seated against seat 33. No water moves through sprinkler 10 and the sprinkler is off. If water is bled from chamber 35, either from a manual or electronic operation, diaphragm 34 is unseated and the inlet water at inlet 31 passes through valve chamber 35 into chamber 36 and the sprinkler is "on". In accordance with this invention, control unit 22 for sprinkler 10 can be manually adjusted to turn the sprinkler "on" or "off" irrespective of the state of an automatic remote control. Furthermore, when an individual sprinkler 10 is on, whether manually or automatically, the pressure for that head 10 may be adjusted by the simple expedient of adjusting a screw in the pressure adjustment control section 42 of control 22.

Figure 2:
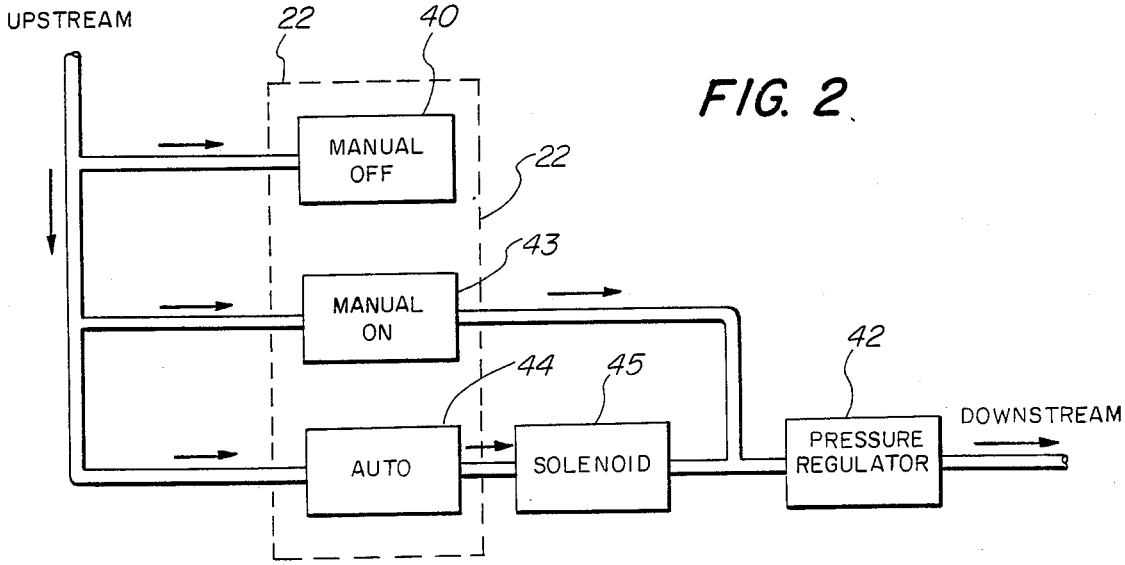
FIG. 2 is a flow schematic useful in describing the invention.

FIG. 2 shows in a schematic way how the invention operates in its dual mode. In FIG. 2 upstream relates to inlet chamber 31, 35. Downstream relates to the bleed return 24 and the interior of sprinkler 10 which includes chamber 36 and spray nozzle chamber 15. Pressure adjustment, automatic and manual on/off share a common conduit between a supply valve and an interior pressure area for each individual head. In FIG. 2 the manual "off", box 40, does not provide water through the pressure adjustment control 42 and thus the pressure cannot be read in this mode. When the manual unit 43 has been activated to "on" by an operator, the valve 20 opens in response to the operator's manual control and water moves through the pressure adjustment control 42 and out nozzle 18 of sprinkler 10. In a similar manner if an automatic "on" 44 is achieved by operation of solenoid 45 (FIG. 1), then water moves through pressure adjustment control 42 and downstream through nozzle 18 of sprinkler 10. In either manual or automatic "on", pressure adjustment control 42 may be adjusted manually while gauge 14 is being read.

The combination of operating modes, in accordance with this invention, allows one person to take a pressure reading and adjust the pressure of any one or all of the heads on a system irrespective of the condition of the master control and without digging up the heads as was required by the prior art.

Figure 4:
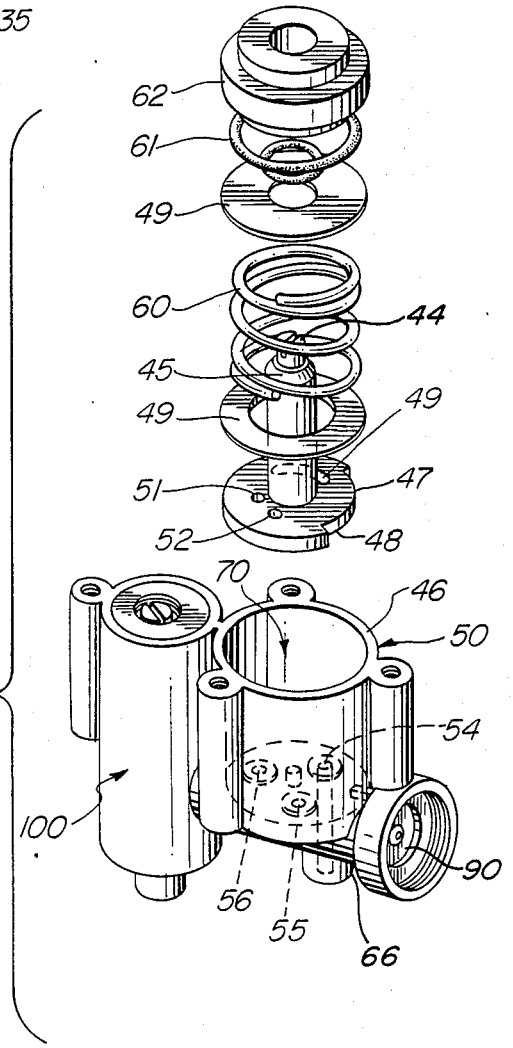
FIG. 4 is a view of a pressure adjusting screw and an exploded view of a manual control valve, both located at, or near, ground level for the head of FIG. 1.
Figure 5:
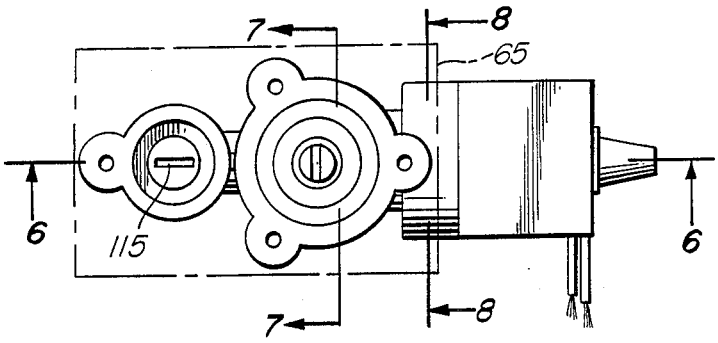
FIG. 5 is a top view of the local pressure adjustment and manual control valve of this invention.

FIG. 4 is an exploded view of the manually adjustable mode control in accordance with this invention. Stem 45 is adapted with a slot 44 for manual rotation. A valve seat 47 is formed or fastened at the bottom of stem 45 and that seat is shaped with an arcuate recess 48 located on the periphery of seat 47. Seat 47 includes an inner arcuate opening 49 and a pair of holes 51, 52 which are formed therethrough. Valve seat 47, as it is rotated, opens and closes pathways for bleed water through the holes 54, 55 or 56, which holes are located at the bottom of housing 46. Washers 49, spring 60 and sealing cover item 61, 62 complete a watertight chamber 70 when held in place by cover 65, shown in FIGS. 6 and 7. Chamber 70, depending upon the position of valve seat 47, receives bleed water through arcuate opening 49 and opening 54 which is in communication with conduit 23, FIG. 1 and 3. Similarly, water from chamber 70 may exit through openings 55 or 56 depending upon the position of seat 47.

Figure 6:
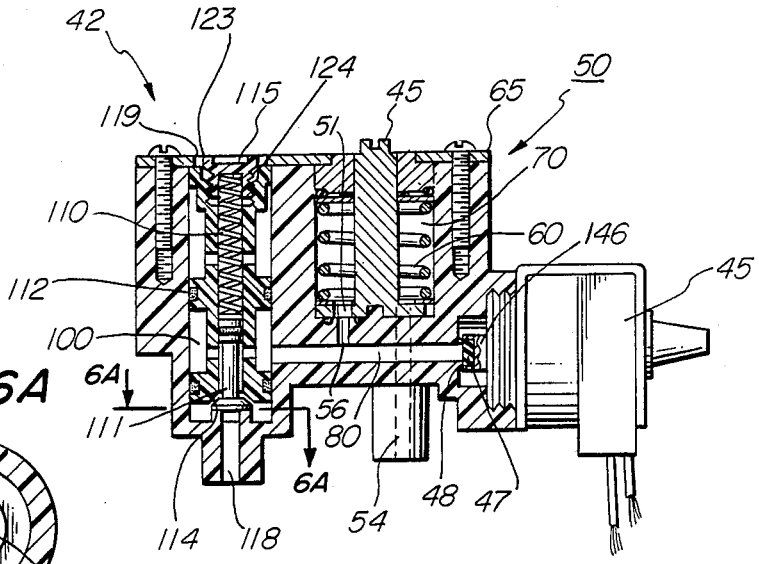
FIG. 6 is a side view taken along the lines 6—6 shown in FIG. 5.
Figure 7:
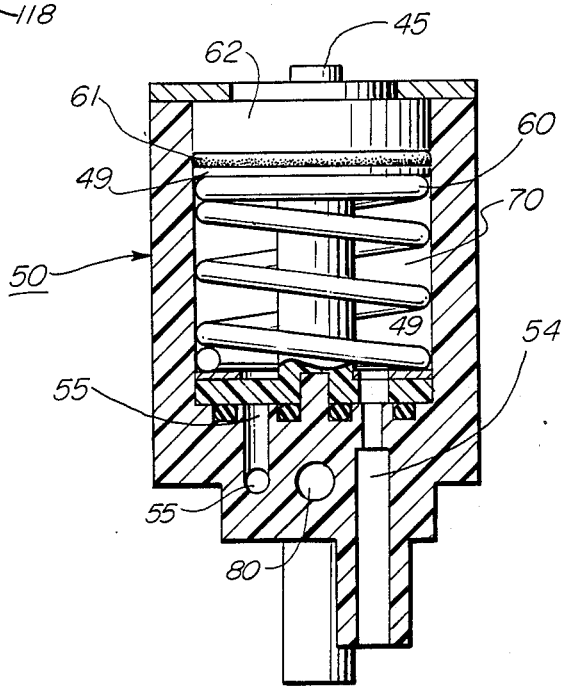
FIG. 7 is an end view taken along the line 7—7 in FIG. 5.
Figure 8:
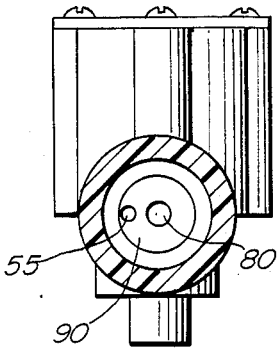
FIG. 8 is an end view taken along the line 8—8 in FIG. 5.

Stop 66 projects into chamber 70 from the outer wall and fits within arcuate recess 48 for purposes of position control over valve seat 47. Thus, stop 66 controls the limits of rotation of stem 45 as it is being rotated during a manual on/off control movement. At one limit—manual on—the openings 49 and 51 are aligned over holes 54 and 56 to form a completed passageway, and at the other limit—manual off—, openings 49 and 52 are aligned over holes 54 and 55 in order to complete another passageway. When 51 is over 56, as is shown in FIG. 6, bleed water is provided to chamber 100 via lateral passageway 80. When 52 is over 55, then bleed water gets as far as chamber 90, FIG. 8, where it is blocked from, or passed into, lateral passageway 80 in accordance with the operational state of solenoid 45.

Figure 6A:
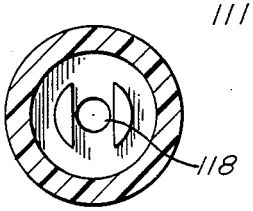
FIG. 6A is a figure taken along the lines 6A—6A of FIG. 6.

Bleed water, upon entering into passageway 80 is directed into the pressure adjustment section 100 in pressure adjustment control 42. Pressure chamber 100 is located below O-ring 112 in seat 122. A groove 115 in the upper head 123 of valve stem 111 provides a tool fitting for control over the pressure on spring 110 as head 123 is turned in its receiving threads 124. O-ring 112 defines an air space between head 122 and cover 65. The air space is vented through vent 119 to ambient pressure. Pressure adjustment spring 110 bears against a pressure adjust valve stem 111. Spring 110, as adjustment screw 115 is rotated, adjusts the volume of water exiting from passageways 80, 100 and pressure adjust seat 114 into outlet opening 118. FIG. 6A depicts that the upstanding ribs beneath the seat of valve stem 111 are provided with opposed slots therethrough. These opposed slots provide a water passage which allows water to enter into opening 118 from chamber 100.

In operation of pressure adjustment 42, the spring pressure is balanced to a back pressure that is present in the downstream chamber 36. Increasing the spring pressure achieves an increase in back pressure in chamber 36 which pressure is, in turn, directly related to nozzle pressure in nozzle chamber 15.

When solenoid 45 is energized, the slug 146 is driven away and breaks the seal at seat 48. The seal is normally formed by resilient material 47 in the front face of slug 146 pressing again seat 48. A fluid flow path from inlet 54 into chamber 70 and out through 55 is completed, via chamber 90, into lateral passageway 80 and thus the pressure adjustment control 42 is against in fluid flow relationship with the internal fluid exiting from nozzle 18 of sprinkler 10. The operations described hereinbefore means that pressure can be easily read and adjusted by a workman when the mode control is in either manual "on" or automatic "on".

The above description presents the best mode contemplated in carrying out may invention. My invention is, however, susceptible to modifications and alternate constructions from the embodiments shown in the drawings and described above. Consequently, it is not the intention to limit the invention to the particular embodiments disclosed. On the contrary, the invention is intended and shall cover all modifications, sizes and alternate constructions falling within the spirit and scope of the invention, as expressed in the appended claims when read in light of the description and drawings.

What is claimed is:

1. A sprinkler having a spray nozzle connected to an internal chamber that receives pressurized water to be delivered out through the nozzle, in combination with an adjustable pressure control regulator adjusting the internal water pressure for said sprinkler, and wherein said activating means is manually operable, said combination comprising:

a valve adaptable for connecting the sprinkler to an underground water source, which source may vary in water pressure;

a manually operable activating means connected to said valve and being readily accessible at an exposed ground-level location for said sprinkler, when said sprinkler is installed in the ground, for activating said sprinkler and causing water from said water source to enter into said internal chamber and to spray out from said sprinkler through said sprinkler's nozzle;

a pressure reading gauge readable at an above-ground location for said installed sprinkler and connectable into said internal chamber of said sprinkler for indicating the internal water pressure for said sprinkler, said gauge being removable from said sprinkler, at which time said sprinkler can return to its standard sprinkler operation following a pressure reading and adjusting operation;

a pressure adjusting control means in fluid communication with said activating means, said valve, and said internal chamber;

said pressure adjusting control means being characterized by an adjustment means accessible at an exposed ground-level location of said installed sprinkler for adjusting the water pressure within said internal chamber of said sprinkler, said pressure being indicated by said removable gauge while said sprinkler is spraying water out through said nozzle;

a remotely-controlled on/off control means connected in series fluid communication with both of said pressure adjustment means and said manually-operable activating means; said on/off control means being operable for turning the sprinkler on or off from a remote location; and said pressure adjustment control means being operable for adjusting said internal pressure of the sprinkler when the sprinkler is "on" from either said manually operable activating means or said remotely-controlled control means.

* * * * *

UNITED STATES PATENT AND TRADEMARK OFFICE

CERTIFICATE OF CORRECTION

PATENT NO. : 4,913,351

DATED : April 3, 1990

INVENTOR(S) : Robert B. Costa

It is certified that error appears in the above-identified patent and that said Letters Patent is hereby corrected as shown below:

Column 2, line 51, "incudes" should read --includes--.

Column 5, line 28, "against" should read --again--.

Signed and Sealed this

Ninth Day of July, 1991

*Attest:*

*Attesting Officer*

HARRY F. MANBECK, JR.

*Commissioner of Patents and Trademarks*